US005628065A

United States Patent [19]

Austin

[11] Patent Number: 5,628,065

[45] Date of Patent: May 13, 1997

[54] FIREFIGHTER HOOD WITH LABEL POCKET

[75] Inventor: Richard A. Austin, Shawnee, Okla.

[73] Assignee: Tayco, Shawnee, Okla.

[21] Appl. No.: 579,966

[22] Filed: Dec. 28, 1995

[51] Int. Cl.[6] ..... A42B 1/00

[52] U.S. Cl. ..... 2/81; 2/5; 2/8; 2/202; 2/203; 2/209.13; 2/246; 2/247; 40/329

[58] Field of Search ..... 2/5, 7, 8, 81, 202, 2/203, 205, 209.13, 246, 247; 40/329, 586; 112/440

[56] References Cited

U.S. PATENT DOCUMENTS

| | | | |
|---|---|---|---|
| 922,608 | 5/1909 | Mayer . | |
| 2,620,483 | 12/1952 | Reinhard | 2/185 |
| 2,803,829 | 8/1957 | Tscharner | 2/199 |
| 3,458,864 | 8/1969 | Austin et al. | 2/5 |
| 3,531,952 | 10/1970 | Chesebro, Jr. | 66/171 |
| 4,573,217 | 3/1986 | Reed | 2/7 |
| 4,650,219 | 3/1987 | Sigman | 283/70 |
| 5,090,054 | 2/1992 | Grilliot et al. | 2/5 |

*Primary Examiner*—Diana Biefeld
*Attorney, Agent, or Firm*—Thompson Hine & Flory LLP

[57] ABSTRACT

The present invention is a protective firefighter hood in which a pocket is formed to protect the required garment label which must be attached to the hood. The hood includes a head portion shaped to cover at least a wearer's head and an optional bib portion attached to and extending from the head portion to cover at least a wearer's neck. In one embodiment, a gap is formed between the stitching that connects the inner and outer layers of the head portion, adjacent the label. Accordingly, the label can be stored so that it does not contact the wearer, by inserting it through the gap in the stitching. In an alternative embodiment, the hood is provided with a patch pocket on the head portion or bib portion adjacent the label, so that the label can be placed alternatively within the pocket away from contacting the wearer or removed from the pocket to be viewed.

12 Claims, 2 Drawing Sheets

FIREFIGHTER HOOD WITH LABEL POCKET

BACKGROUND OF THE INVENTION

The present invention relates to a protective hood for a firefighter, and more particularly, to a pocket for containing a required clothing label attached to such a hood so that the label is prevented from contacting and causing discomfort to the wearer.

In order to protect the sensitive head, face and neck areas which are not protected by the protective coat, helmet or facepiece, firefighters wear hoods which are shaped to cover the head, neck and shoulder regions and include a front opening for exposure of the wearer's face. Such hoods serve to eliminate the possibility of a gap in the protection around the neck, cheek and ears, between the helmet, face mask and coat collar of the firefighters. Such hoods are constructed of fire retardant, thermal barrier material, such as a knit aramid material (e.g., NOMEX, a trademark of E.I. Dupont de Nemours & Co., Inc.) to protect a firefighter against burns in the regions covered by the hood. Typically, such firefighter hoods are made of two layers of knitted fabric material.

Current regulations require that all firefighter apparel include garment labels permanently and conspicuously attached to the inside of the garment, which set forth the fabric composition of the associated garment, cleaning instructions, and the like. Applicable regulations also require that such labels be made of a fire resistant material, such as aramid fiber. A problem with such labels is that they present a source of irritation to the wearer, should the labels contact the skin of the wearer. In addition, perspiration and the movement of the firefighter's head provides constant abrasion on the label. The abrasion and perspiration cause the label to become illegible and eventually wear away. This is important, as some states require the label to be legible for the hood to stay in service.

Accordingly, there is a need for means for effectively providing a flame and heat resistant label which is attached to a firefighter hood, is readily available for reading, and yet is located at a position away from the wearer and away from possible flame damage. Further, there is a need for a "housing" for a flame and heat resistant label for a firefighter hood so that the label does not contact the skin of the firefighter, and to extend the service life of the hood by extending the integrity of the label.

SUMMARY OF THE INVENTION

The present invention is a firefighter hood which is designed such that an associated garment label can be stored away from contact with a wearer. In a preferred embodiment of the invention, a gap is formed in the stitching that connects the inner and outer layers of the hood, adjacent to the label. Accordingly, the label can be stored so that it does not contact the wearer by inserting it through the gap in the stitching, so that the label is positioned between the layers of the hood. In an alternative embodiment, the hood is provided with a pocket adjacent the label, so that the label can be placed within the pocket. Such a "patch pocket" is made of the same material as the hood and is stitched to the inner or outer layer of the hood.

In a preferred embodiment of the invention, the protective firefighter hood includes a head portion shaped to cover at least a wearer's head and ears, a bib portion extending from the head portion shaped to cover at least a wearer's neck, a label attached to the firefighter hood, the label made of fire-resistant material, a pocket formed in the hood such that the label may be placed alternately inside the pocket so that the label lies between two layers of material, nonadjacent the wearer, or removed from the pocket to be viewed.

In the former preferred embodiment, the head portion of the hood is formed of inner and outer layers of material. A seam is located between the head portion and the bib portion of that hood and the pocket is formed by a gap between the inner and outer layers of material.

Accordingly, it is an object of the present invention to provide a protective firefighter hood in which a required label can be stored so as to preserve the integrity of the label and prevent contact with the wearer; a firefighter hood which includes a pocket to receive and store a label; a hood having a pocket in which the label is easily manipulated to reveal or enclose the label; and a hood which is relatively inexpensive and easy to use and maintain.

Other objects and advantages of the present invention will be apparent from the following description, the accompanying drawings and the appended claims.

DETAILED DESCRIPTION

Figure 1:
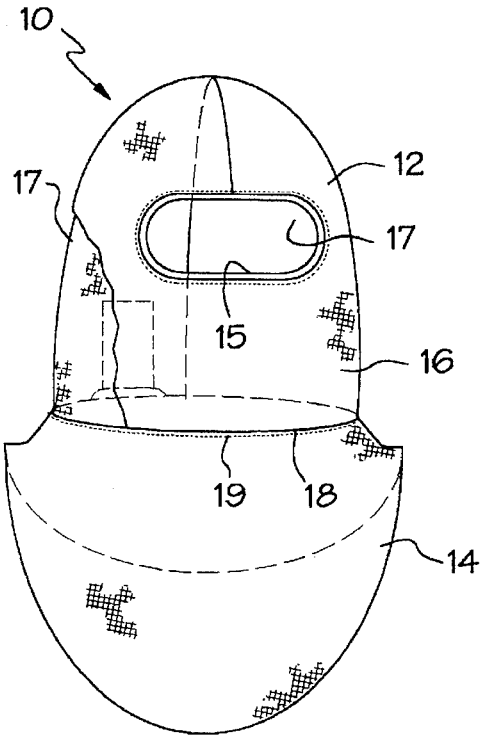
FIG. 1 is a front elevational view of a firefighter hood of the present invention.

As shown in FIG. 1, a protective firefighter hood, generally designated 10, in accordance with the present invention in shaped to receive the head of the firefighter. The hood 10 includes a head portion 12 which is shaped to cover the forehead, ears and chin of the wearer and an optional bib portion 14 which is shaped to cover the neck and a portion of the chest and shoulders of the wearer. The head portion 12 includes a substantially oval front opening 15 for the exposure of the wearer's eyes, nose and mouth. The head portion 12 is made of outer and inner layers 16,17, respectively, which are coextensive over the head portion 12 of material (see also FIGS. 2 and 3).

The hood 10 is made of a flame and heat resistant knit material which, although not shown here, could easily be modified to include additional layers to provide chemical, radiological or fluid-borne biological protection. The hood preferably is formed of an aramid fiber such as NOMEX, polybenzamidazole ("PBI") by Hoechst Calanese Corporation, P-84 (a rayon/KEVLAR blend manufactured by Spring Mill), KEVLAR (a trademark of E.I. Dupont de Nemors & Co., Inc.) or a blend of any of these materials.

Figure 2:
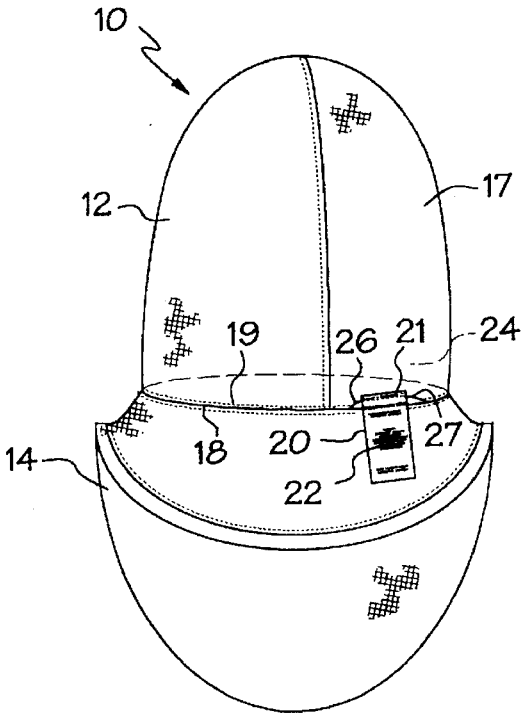
FIG. 2 is a rear elevational view of the hood of FIG. 1 inside-out, showing the label.

As shown in FIGS. 1 and 2, the layers 16,17 of the head portion are joined to the single layer of the optional bib portion 14 at a seam 18 by stitching 19. The hood 10 includes a label 20, which is attached by stitching 21 to a bottom edge of the inner layer 17. The label 20 includes indicia 22 which contains vital and required information such as safety warnings, manufacturer information, fabric contents, sizes and/or washing instructions. The label 20 must also be made of flame-resistant material, for example, aramid material.

Figure 3:
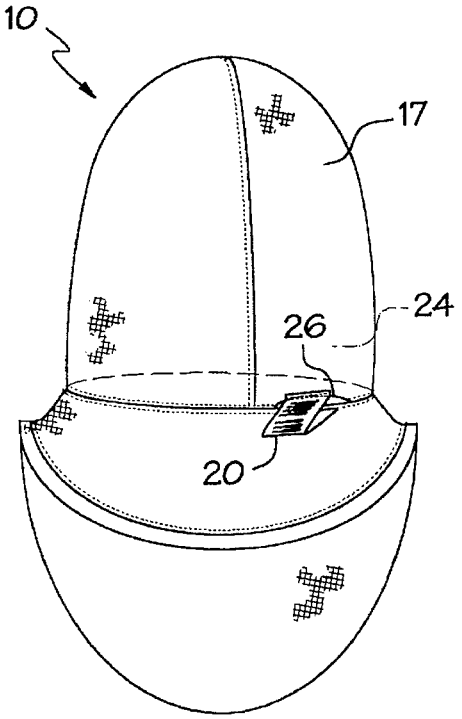
FIG. 3 is the hood of FIG. 2 showing the insertion of the label in the pocket.
Figure 4:
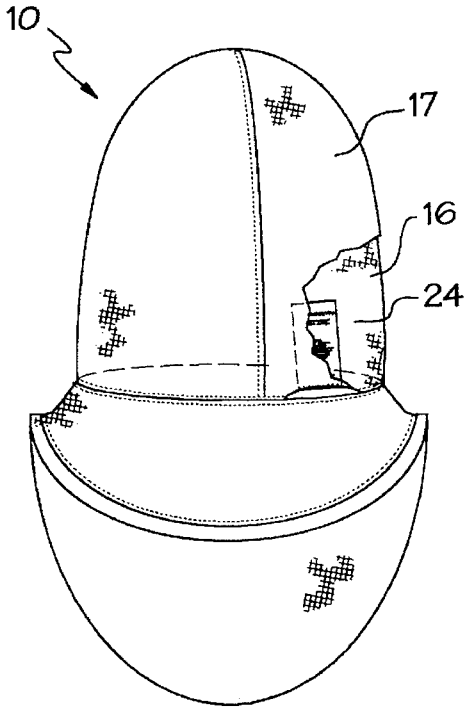
FIG. 4 is the hood of FIG. 2 showing the label inserted in the pocket.

According to the present invention, as shown in FIGS. 2–4, the hood 10 includes a pocket 24 to keep the label away from the wearer's skin as well as protecting it from the heat and flames. In this embodiment, the pocket 24 exists between the outer an inner layers 16,17 of the head portion 12 and is formed by providing a gap 26 in the stitching 19 between the outer and inner layers 16,17 of material on the head portion 12. Preferably, this gap 26 is made between the bottom edge 27 of the inner layer 17 and the seam 18 on the inside of the hood. Alternatively, the gap can be between the outer layer 16 and the seam 18 on the outside of the hood. The gap 26 is made slightly larger than the width of the label 20 so that the label can easily be inserted into and removed from the pocket 24.

As shown in FIG. 3, to insert the label 20 into the pocket 24, the label 20 is first folded and then is inserted into the gap 26 where it lays flat in the pocket 24 between the outer and inner layers 16,17 of material (see in FIG. 4). In this position, it is located both away from the wearer's skin and away from possible damage due to external conditions. Once stored in this fashion, the label may be easily removed to be viewed.

Figure 5:
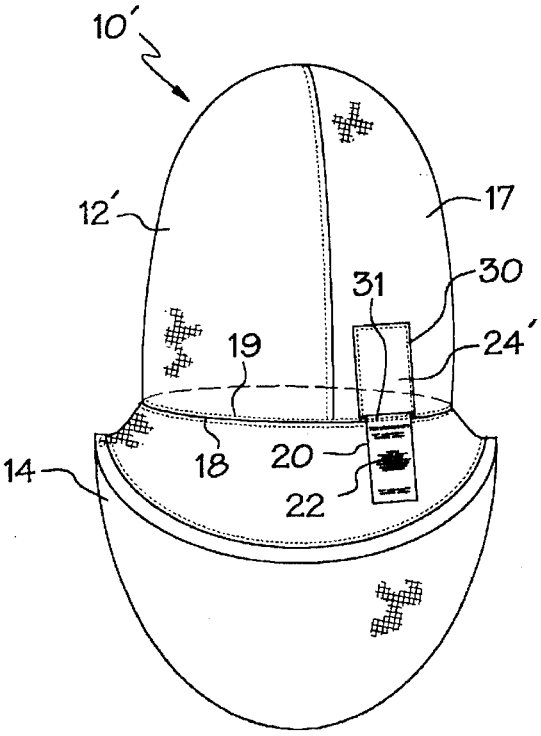
FIG. 5 is a rear elevational view of an alternative embodiment of the firefighter hood of the present invention turned inside out.
Figure 6:
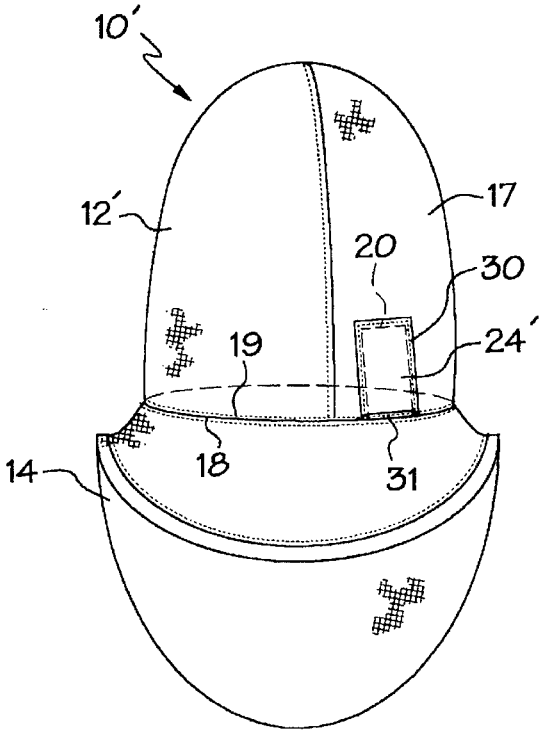
FIG. 6 is the hood of FIG. 5 showing the label inserted in the pocket in a stored configuration.
Figure 7:
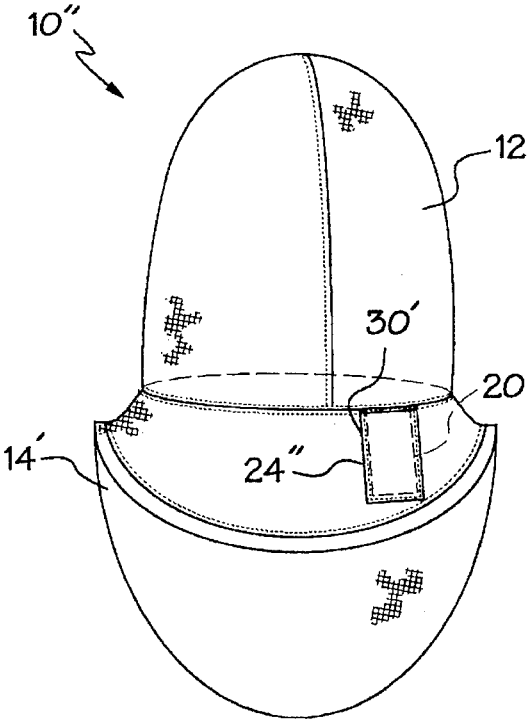
FIG. 7 is a rear elevational view of an alternative embodiment of the firefighter hood of FIG. 5.

An alternative embodiment of the hood 10 of the present invention is shown in FIGS. 5 and 6. In this embodiment, the pocket is in the form of a patch of material 30 which is sewn onto the head portion 12' adjacent to the label 20 by stitching 31. The material 30 also is a knit aramid material such as NOMEX. FIG. 5 shows the label 20 outside of and adjacent to the patch pocket 24'. This pocket 24' is slightly larger than the label 20 itself. Alternatively, as shown in FIG. 7, the pocket 24" may be sewn to the bib portion 14' of the hood 10". As shown in FIGS. 6 and 7, when the label 20 is inserted into the pocket 24' or 24", the wearer is isolated from the irritating label and the label is protected from the harsh firefighting environment.

Having described the invention in detail and by reference to preferred embodiments thereof, it will be apparent that modifications and variations are possible without departing from the scope of the invention defined in the appended claims.

What is claimed is:

1. A protective firefighter hood comprising:

a head portion shaped to cover a wearer's head;

a label attached to the firefighter hood, the label made of fire-resistant material;

the hood including a pocket shaped to receive the label such that the label may be alternately placed inside the pocket away from contacting the wearer, or removed from the pocket to be viewed.

2. The firefighter hood of claim 1 wherein the head portion includes an inner layer and an outer layer, the inner and outer layers being substantially coextensive over the hood portion.

3. The firefighter hood of claim 2 wherein the pocket includes an opening formed by a gap between the inner and outer layers of the head portion, and wherein the pocket is formed between the inner and outer layers on the head portion of the hood.

4. The firefighter hood of claim 1 wherein the pocket includes a separate piece of material sewn to the hood adjacent to the label.

5. The firefighter hood of claim 1 wherein the pocket has a length and width such that the label lies flat within the pocket.

6. The firefighter hood of claim 1 wherein the label is made of an aramid fiber.

7. The firefighter hood of claim 1 wherein the pocket is comprised of aramid material.

8. A protective firefighter hood comprising:

a head portion shaped to cover a wearer's head, the head portion having substantially coextensive inner and outer layers of material;

a bib portion attached to and extending from the head portion and shaped to cover at least a wearer's neck and a portion of the shoulder and chest region;

a seam connecting the head portion to the bib portion;

a label made of flame and heat resistant material and sewn to the firefighter hood at the seam;

the hood including a pocket having a length and width larger than the label and shaped to receive the label, being adjacent to the label such that the label may be alternatively placed to lie flat inside the pocket away from contacting the wearer or removed from the pocket to be viewed.

9. The firefighter hood of claim 8 wherein the pocket includes an opening formed by a gap in the seam between the bib portion and the head portion, and wherein the pocket is formed between the inner and outer layers on the head portion of the hood.

10. The firefighter hood of claim 8 wherein the pocket includes a separate piece of material sewn to the hood at the seam of the head portion to the bib portion, the pocket being adjacent to the label.

11. The firefighter hood of claim 8 wherein the label is comprised of aramid fiber.

12. The firefighter hood of claim 8 wherein the pocket is made of aramid material.

* * * * *